US005905933A

United States Patent [19]

Murai

[11] Patent Number: 5,905,933

[45] Date of Patent: May 18, 1999

[54] DOCUMENT DETECTING APPARATUS

[75] Inventor: Toshiharu Murai, Kawasaki, Japan

[73] Assignee: Ricoh Company, Ltd., Tokyo, Japan

[21] Appl. No.: 08/897,579

[22] Filed: Jul. 21, 1997

[30] Foreign Application Priority Data

Jul. 20, 1996 [JP] Japan ..... 8-209340
Jan. 22, 1997 [JP] Japan ..... 9-024350

[51] Int. Cl.[6] ..... G03G 15/00

[52] U.S. Cl. ..... 399/376; 399/16; 399/51

[58] Field of Search ..... 399/16, 17, 18, 399/38, 45, 51, 52, 177, 208, 365, 370, 376

[56] References Cited

U.S. PATENT DOCUMENTS

| | | | |
|---|---|---|---|
| 4,713,550 | 12/1987 | Anzai et al. | 399/16 X |
| 4,954,846 | 9/1990 | Matsuo et al. | 399/51 |
| 5,119,130 | 6/1992 | Tsudaka et al. | 399/376 |
| 5,181,073 | 1/1993 | Araki | 399/16 |
| 5,223,904 | 6/1993 | Umezawa | 399/376 |

FOREIGN PATENT DOCUMENTS

| | | |
|---|---|---|
| 1-186923 | 7/1989 | Japan . |
| 2-308236 | 12/1990 | Japan . |
| 4-67136 | 3/1992 | Japan . |

*Primary Examiner*—Sandra Brase
*Attorney, Agent, or Firm*—Oblon, Spivak, McClelland, Maier & Neustadt, P.C.

[57] ABSTRACT

A document detecting apparatus installed and used in an image forming apparatus that projects a scanning light is incident to a document placed on a document mount and a size and a position of the document are detected by detecting light reflected from the document, including a document pressing device which presses the document on the document mount, an opening or closing detecting device which detects opening or closing state of the document pressing device, and while the document pressing device is detected as in an opening state, document detecting operation is executed repeatedly and a detecting result is renewed, and, just before it is detected that the pressing board is closed or just before it to detected that an operation for reading an image of the document starts, the size and the position of the document are calculated on the basis of the of the detecting result in a calculation processing device.

13 Claims, 13 Drawing Sheets

DOCUMENT DETECTING APPARATUS

BACKGROUND OF THE INVENTION

1. Field of the Invention

The present invention relates to detecting a size and a position of a paper. The present invention is more particularly related to a document detecting apparatus of an image forming apparatus for detecting a size and a position of a document based on directing incident light to the document and detecting light reflected therefrom.

2. Discussion of the Background

In an image forming apparatus such as a copying machine, it is helpful if a scanning range of an optical system is set and a paper sheet cassette is selected automatically. For this reason, a document detecting apparatus is installed in an image forming apparatus for detecting a size and position of a document by directing incident light to the document and detecting reflected light from the document.

Conventionally, this type of document detecting apparatus has problems resulting from a complicated structure and that an operator may mistakenly operate the apparatus by not distinguishing preliminary light scanning and exposing scanning. Further, a pulsating disturbance light, such as an incandescent lamp is not completely prevented from interfering with detection of incident light reflected from the document.

Whereas, Japanese Laid Open Patent No. 1990-308236 discloses a document size and position detecting apparatus, in which the document size and position is detected accurately and rapidly by a control device, on the basis of information obtained from twice light scanning by a light scanning device which is operated by a closing operation of a document pressing board which fixes the document on a contact glass. The above described patent is further of a simple structure in which wiring of an exposure scanning unit is prevented.

Moreover, Japanese Laid Open Patent No. 1992-67136 discloses a document detecting apparatus in which an on/off controlled impulse light is directed to a document from a light emitting block and an output signal outputted from a light detecting block is filtered in a high pass active filter, and thereby direct light disturbances of a direct current such as a sun light and pulsating light disturbances such as from an incandescent lamp etc. are prevented from being included therein.

Moreover, Japanese Laid open Patent No. 1989-186923 discloses a document size detecting apparatus in which existence of a document is determined by comparing a light detecting signal from a light sensor which is obtained by scanning a document with reference to a predetermined value, and the size of a document is detected based on a measurement timed in accordance with when the light detecting signal changes from a logic value "1" to "0".

Further, a document detecting apparatus is also proposed in which a light detecting signal distribution is acquired by scanning when a light emitting source is on and a second light detecting signal distribution is acquired by scanning when the light emitting source is off. A difference between the first and second signal distributions is calculated, and thereby a document detecting signal is determined with disturbance light influences removed.

In Japanese Laid Open Patent No. 1990-308236, it is necessary that document detecting is executed during a short time while the document pressing board is closed. In order to obtain enough resolution for high accuracy document detecting, high performance parts and a complicated design are required, and thus an apparatus becomes complicated and manufacturing costs are increased.

In Japanese Laid Open Patent No. 1992-67136, the disturbance light is removed effectively when in steady state, however, during scanning, rapid changes in incident light due to disturbances pass the filter and are detected, and further, with respect to some reflecting light, detection becomes unstable by a transient response property of the filter.

Moreover, in some cases, for example, even when a light emitting source is driven at a duty ratio of 50%, a duty ratio of a received binary signal may be shifted largely by properties of an optical system and a circuit system receiving the binary signal. In this case, according to a phase relation between a clock and a received output signal, light reflected from the document is not properly received preventing document detection. Further, on the basis of an on/off driving of the light emitting source, an error range generates at an edge portion of the document that may prevent detection of the edge portion of the document.

Moreover, in the apparatus in which the light detecting signal distribution is acquired by scanning when the light emitting source is on and light detecting signal distribution acquired by scanning when the light emitting source is off, an A/D converter and a large capacity memory are necessary, and thus an apparatus becomes complicated and of large size. Further, signal processing becomes complicated and processing time is extended.

And finally, a small size and low torque motor is often used for driving an optical system of a document detecting apparatus, because of a small size and a simple structure of such apparatus. However, if rotation of the motor becomes abnormal by some cause, proper scanning by the optical system cannot be executed, preventing proper document detection.

SUMMARY OF THE INVENTION

Accordingly, it is an object of the present invention to provide a document detecting apparatus that provides high accuracy document detection in a short time, that includes preventing disturbance light from influencing document detection so that an edge portion of a document is accurately detected, and in which the apparatus is not complicated, and has a simple structure.

Another object of the present invention in to provide a document detecting apparatus that is small in size and has reduced manufacturing costs achieved in part by the small size and use of a low torque motor.

These and other objects are achieved according to the present invention which provides a document detecting apparatus installed and used in an image forming apparatus including a scanning light incident to a document placed on a document mount that detects a size and a position of the document by detecting light reflected from the document. The apparatus includes a document pressing device which presses the document on the document mount, an opening or closing detecting device which detects an opening or closing state of the document pressing device, and a document detecting operation is executed repeatedly while in said opening state, and, a calculation processing device calculates a size and position of the document on the basis of a detecting result just before it is detected that the pressing board is closed or just before it is detected that an operation for reading an image of the document starts.

BRIEF DESCRIPTION OF THE DRAWINGS

In describing the preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner.

A more complete appreciation of the present invention and many of the attendant advantages thereof will be more readily obtained as the same becomes better understood by reference to the following detailed description when considered in connection with the accompanying drawings, wherein:

FIG. 6(*b*) is a timing diagram illustrating timing of the scanning light illustrated in FIG. 6(*a*);

FIG. 14(*b*) is a side explanation view illustrating structure of the motor according to the third embodiment;

DESCRIPTION OF THE PREFERRED EMBODIMENT

Referring now to FIGS. 1 to 10, a first embodiment of the present invention will be described.

Figure 1:
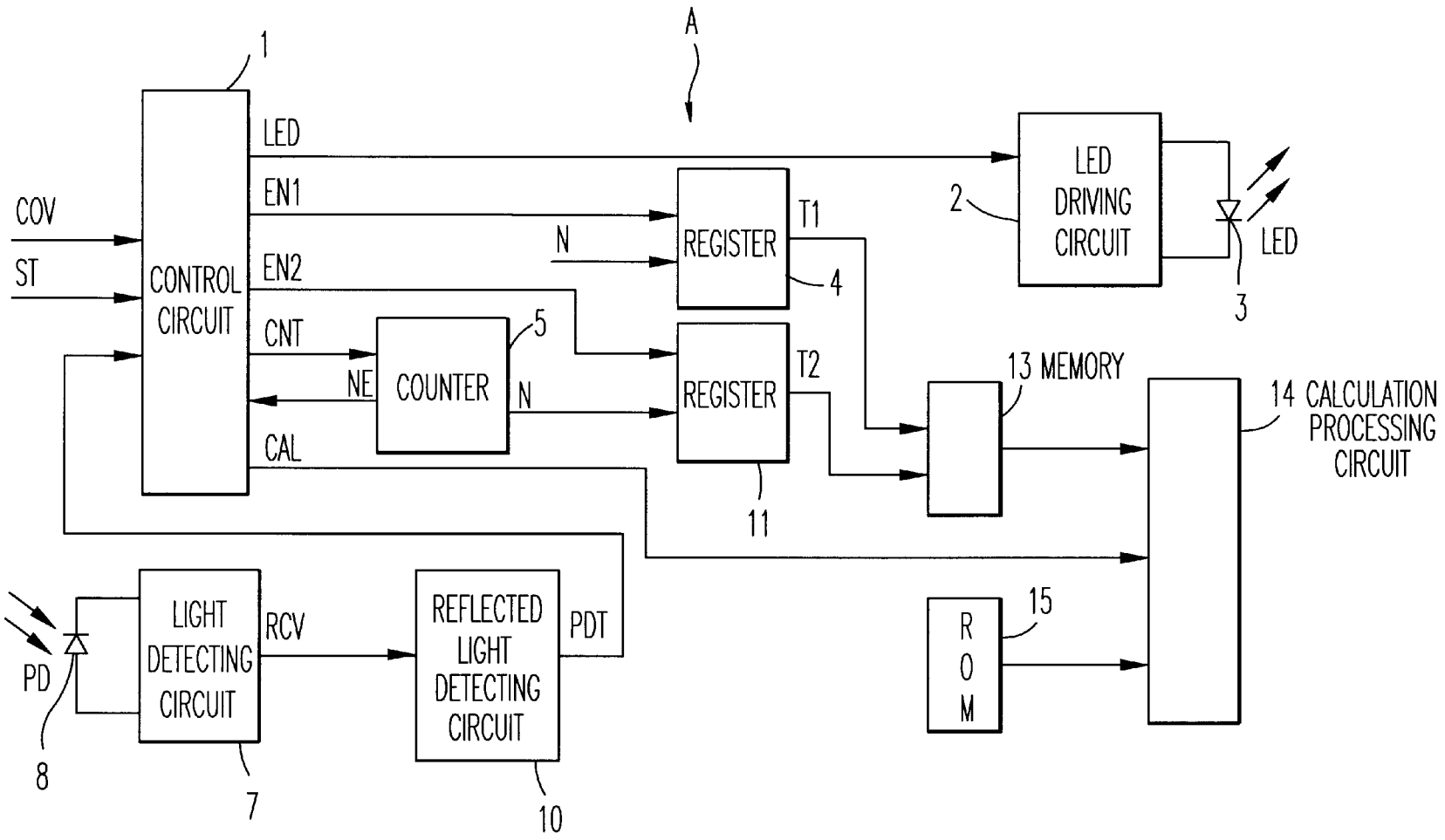
FIG. 1 is a block diagram illustrating a first embodiment of a document detecting apparatus according to the present invention.

As shown in FIG. 1, a document detecting apparatus A includes a photodiode 8 that receives light incident thereto and outputs a corresponding signal to a light detecting circuit 7 where the signal is amplified, converted to binary, and output as a detected light signal RCV. The light detecting circuit 7 is connected to a reflected light detecting circuit 10 which distinguishes a level of the detected light signal RCV, by reading it according to periods of plural clocks. A detecting signal PDT is output from a terminal of the reflected light detecting circuit 10 to a control circuit 1 which executes total control of the document detecting apparatus A.

Figure 5:
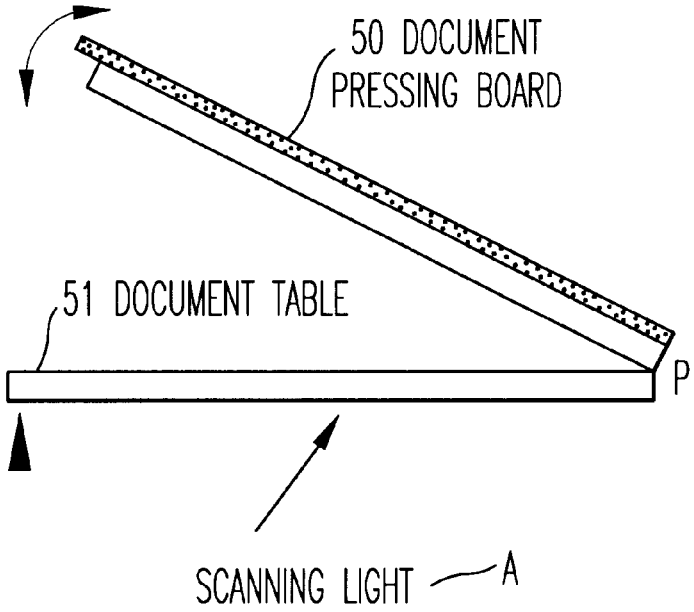
FIG. 5 is an explanation view illustrating a document pressing board installed on a document table according to the first embodiment.

As shown in FIG. 5, the document detecting apparatus A includes a transparent document table 51 on which a document is placed, and a pressing board 50. When the pressing board 50 is closed less than a predetermined angle θ, a signal COV outputs.

The COV signal, and a reference position signal ST which is output when a scanning light incident to the document on the document table 51 arrives at a predetermined position with respect to the document, are input to the control circuit 1. Further, a LED driving circuit 2 connects to the control circuit 1 and a light emitting diode 3 which emits the scanning light to the document.

The control circuit 1 outputs a control signal LED to the LED driving circuit 2 when a logic value of the COV signal is "0". The LED control signal operates the LED driving circuit 2 which causes LED 3 to emit the scanning light at an ON-OFF modulated frequency of predetermined period.

Figure 2:
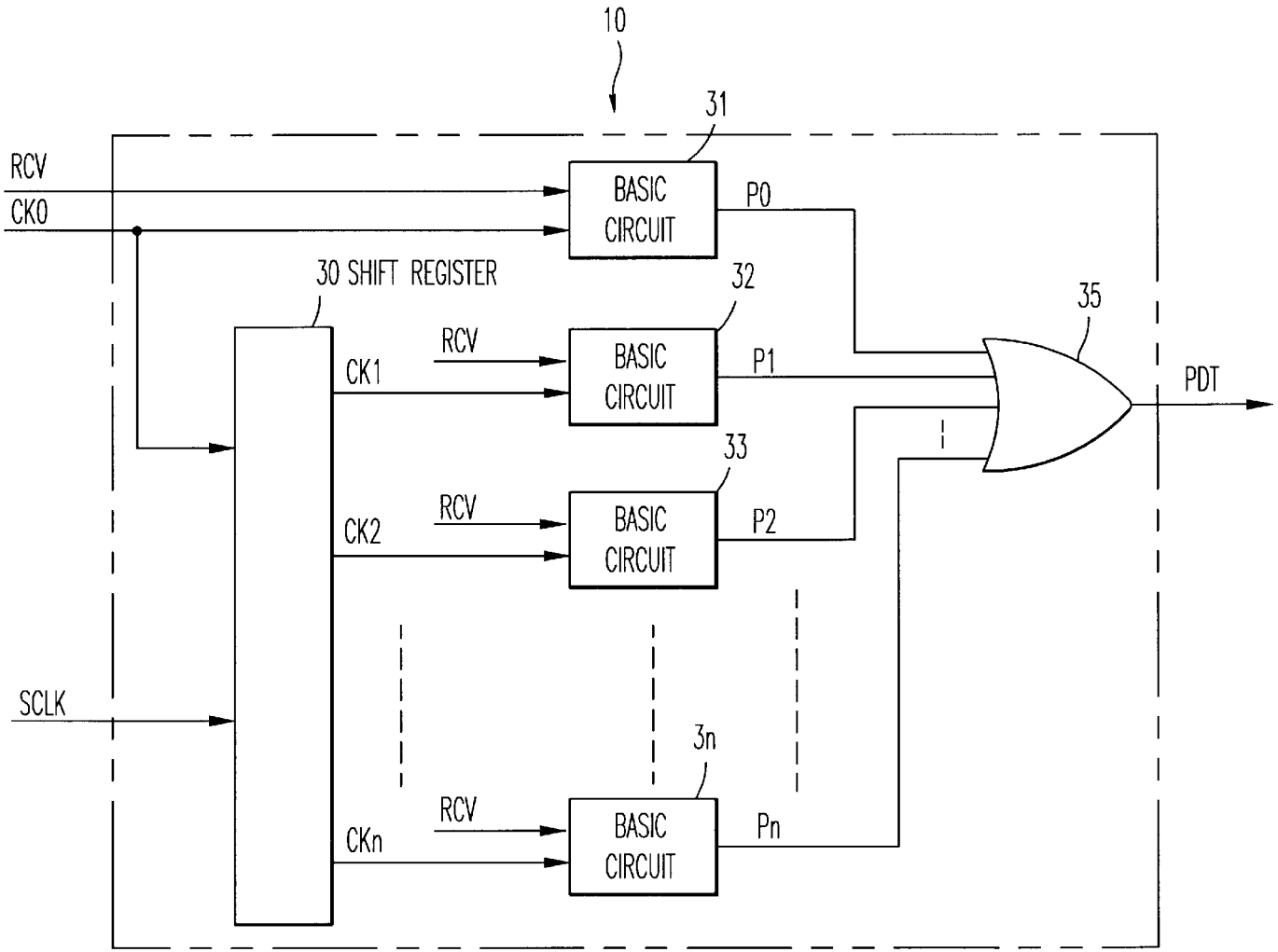
FIG. 2 is a block diagram of a reflected light detecting circuit present in FIG. 1.

The reflected light detecting circuit 10 has a structure as shown in FIG. 2 that includes a shift register 30 which executes shift operations. A system clock SCLK and clock CK0 are also provided. The clock CK0 is synchronized with the system clock SCLK and has frequency twice as high as the ON-OFF frequency of the light emitting diode. The clock CK0 is input to the shift register 30, and clocks CK1–CKn of which phase are different from each other are output from the shift register 30. The frequency of the system clock SCLK is (n+1) times as high as that of the clock CK0 and is also input to the shift register 30.

Moreover, in the reflected light detecting circuit 10, there is installed a basic circuit 31 which has the detected light signal RCV and clock CK0 as inputs. The basic circuit 31 distinguishes a level of the detected light signal RCV by reading the detected light signal RCV by the clock CK0 and outputting a signal P0 in accordance thereof.

Similarly, in the reflected light detecting circuit 10, there is installed basic circuits 31–3n which the detected light signal RCV and each of n clocks CK1–CKn of different phase are input. Basic circuits 31–3n each distinguish a level of the detected light signal RCV by reading the detected light detecting signal RCV according to a respective one of clocks CK1–CKn and outputting a respective signal P1–Pn. Output terminals of the basic circuits 31–3n are input to input terminals of an OR circuit 35.

Figure 3:
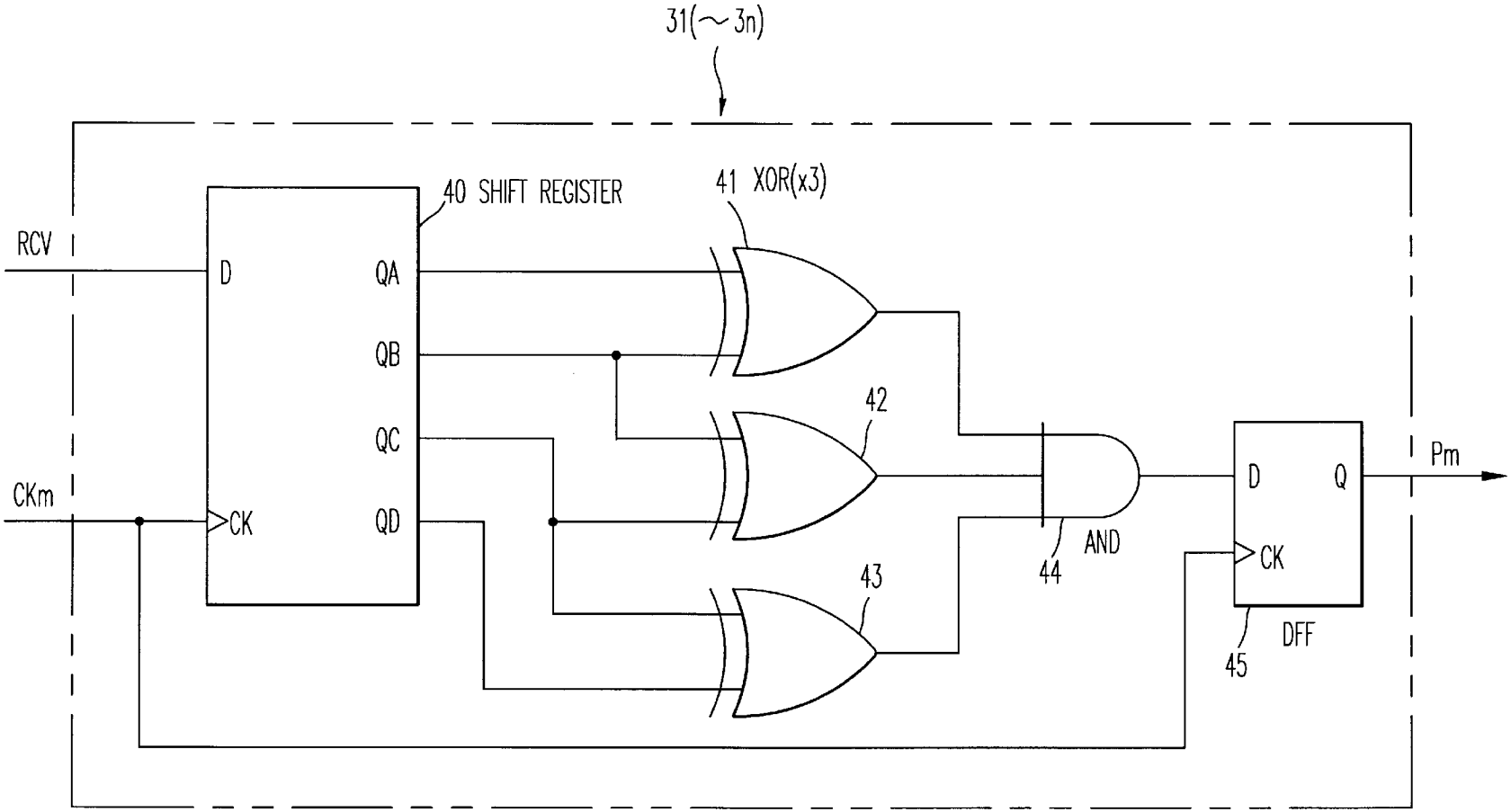
FIG. 3 is a block diagram of a basic circuit present in FIG. 2.

The basic circuits 31–3n are of a structure as shown in FIG. 3. Shift register 40, which the detected light signal RCV is input, has terminals QA and QB which are connected to input terminals of an exclusive OR circuit 41, terminals QB and QC which connect to input terminals of an exclusive OR circuit 42, and terminals QC and QD connect to input terminals of an exclusive OR circuit 43. Output terminals of the exclusive OR circuits 41–43 connect to input terminals of an AND circuit 44, and an output terminal of the AND circuit 44 connects to a D terminal of a flip flop 45. The clock CKm inputs to CK (clock) terminals on each of the shift register 40 and the flip flop 45.

Returning to FIG. 1, in the reflected light detecting circuit 10 in which the basic circuits 31–3n are provided as shown in FIG. 3, the output terminal of the OR circuit 35 as shown in FIG. 2 connects to the control circuit 1. A counter 5 outputs a clock for measuring a front edge and a back edge of the document by counting the internal system clock SCLK, a register 4 which measures a start position of input of the document data, a register 11 which measures an end position of input of the document data, and a calculation processing circuit 14 which calculates document detecting according to the measured positions are connected to the control circuit 1.

An output terminal of the counter 5 connects to the registers 4 and 11, output terminals of the registers 4 and 11 connect a memory 13 which stores measuring values obtained by registers 4 and 11, an output terminal of a memory 13 connects to the calculation processing circuit 14, and a ROM 15 which stores data for calculation of document detecting connects to the calculation processing circuit 14.

Figure 4:
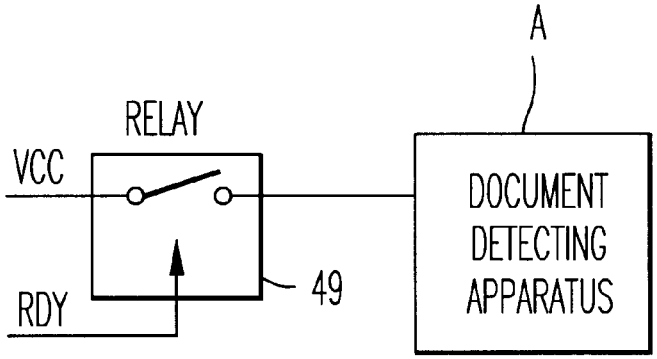
FIG. 4 is a block diagram of a power supply block according to the first embodiment.

As shown in FIG. 4, an electric power supply VCC is supplied to the document detecting apparatus A by way of a relay 49. Relay 49 cuts off VCC in accordance with a waiting signal RDY which is output when the image forming apparatus in which the document detecting apparatus A is installed is in waiting condition.

Next, operation of the first embodiment will be described. Basic operation regarding incident of scanning light to the document and detecting a light signal reflected therefrom will be described first.

Figure 6B:
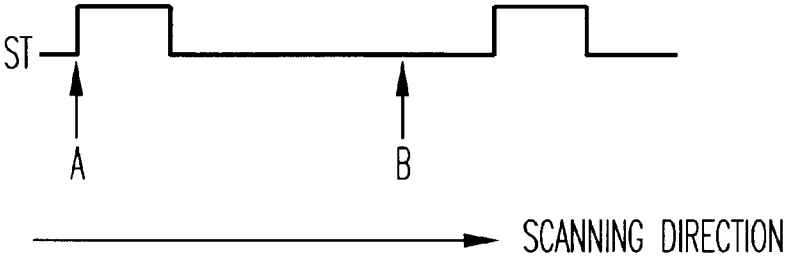
FIG. 6(*a*) is an explanation view illustrating a scanning light incident to a document of the first embodiment.
Figure 6A:
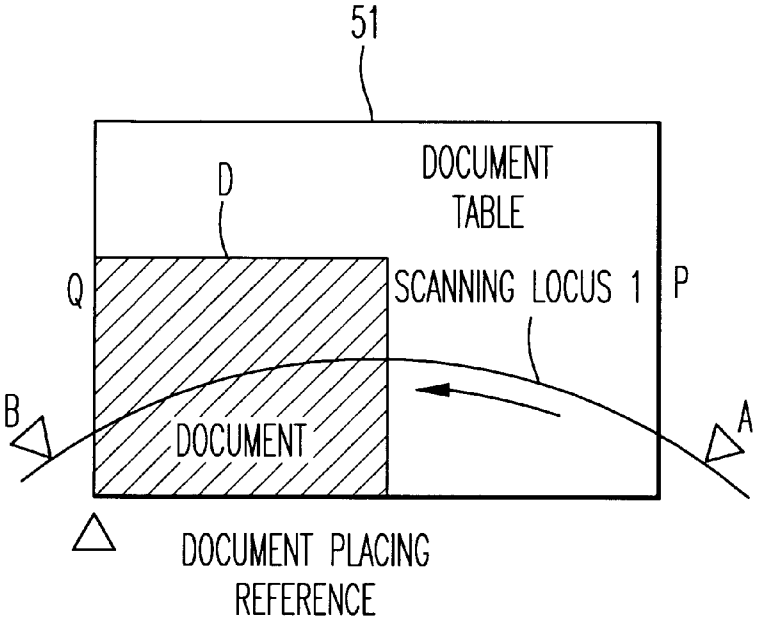
Figures 7A, 7B:
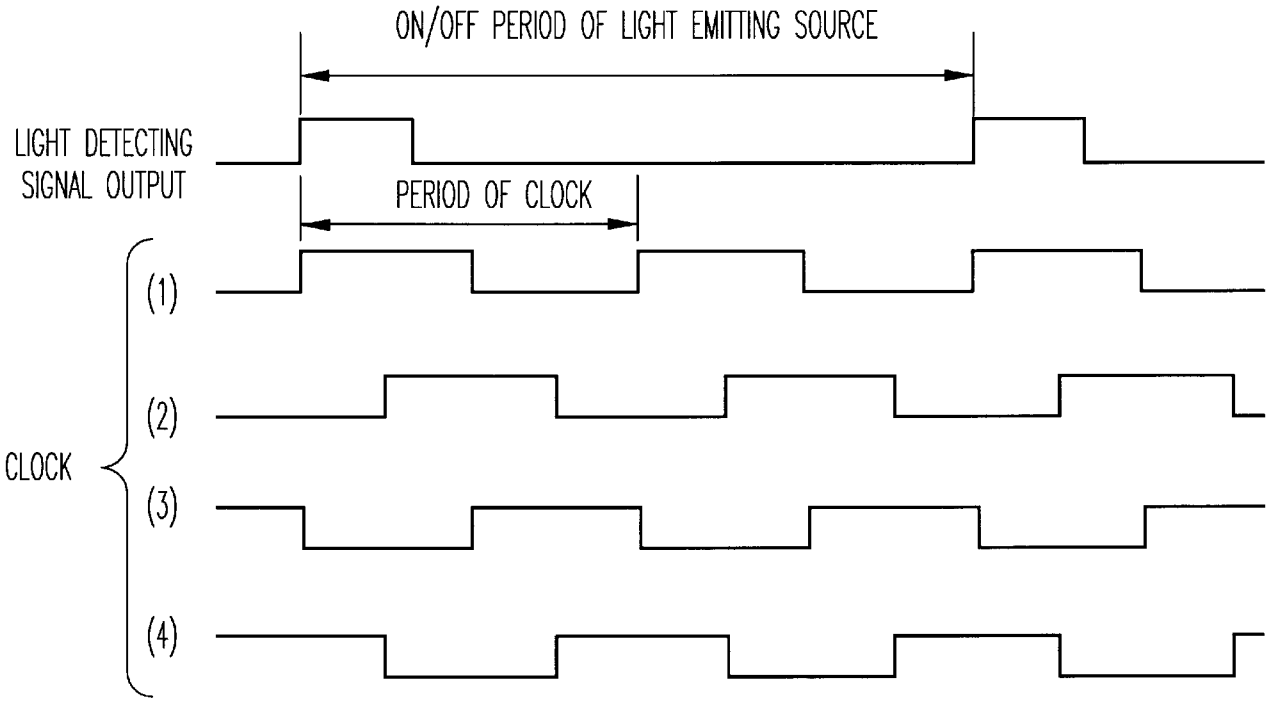
FIGS. 7(*a*) and 7(*b*) are timing diagrams illustrating modulation of reflected light from a document based on plural clocks of different phases according to the first embodiment.

In this embodiment, the scanning light is incident to the document D placed on the document table 51 as the scanning light moves in a locus from a far side to a near side with respect to a document placing reference and the document D, as shown in FIG. 6(*a*).

In this case, at a scanning starting position A before the scanning light reaches an edge P of the document table 51, the reference position signal ST is generated, and the control signal LED is input to the LED driving circuit 2 causing the light emitting diode 3 to emit the ON/OFF modulated scanning light. The scanning light from the light emitting diode 3 is repeatedly incident to the document while the pressing board is open.

Thus the reference position signal ST becomes a periodic pulse as shown in FIG. 6(*b*) and moreover once scanning ends at a position B where the scanning light passes an edge Q of the document table.

The detected light signal RCV from the light detecting circuit 7 inputs to the reflected light detecting circuit 10, and to the basic circuits 31–3n thereof. The level of the detected light signal RCV is distinguished independently by reading the detected light signal RCV in accordance with the clocks CK0 and CK1–CKn each of which are phase shifted by a predetermined time with respect to the clock CK0 that has a frequency twice as high as the ON/OFF frequency of the light emitting diode 3. Signals P0–Pn are output from the basic circuits 31–3n according to the signal level read by each circuit.

In this case, in the basic circuits 31–3n, the detected light signal RCV inputs to the shift register 40 one by one in accordance with clock CKm. The shift register 40 outputs signals QA, QB, QC, and QD to the exclusive OR circuits 41–43 and the exclusive OR circuits 41–43 are output to the AND circuit 44. Here, if a value of outputs QA, QB, QC and QD of the shift register 40 transit alternately, all logic values of the outputs of the exclusive OR circuits 41–43 become "1" and a logic value of the output of the AND circuit 44 also becomes "1". A waveform of this output signal is sharpened in the flip flop 45 and outputs therefrom as a signal Pm.

The signals P0–Pn input to the OR circuit 35 and a detecting signal PDT corresponding to the signals P0–Pn is output to the control circuit 1 from the OR circuit 35.

Figure 10:
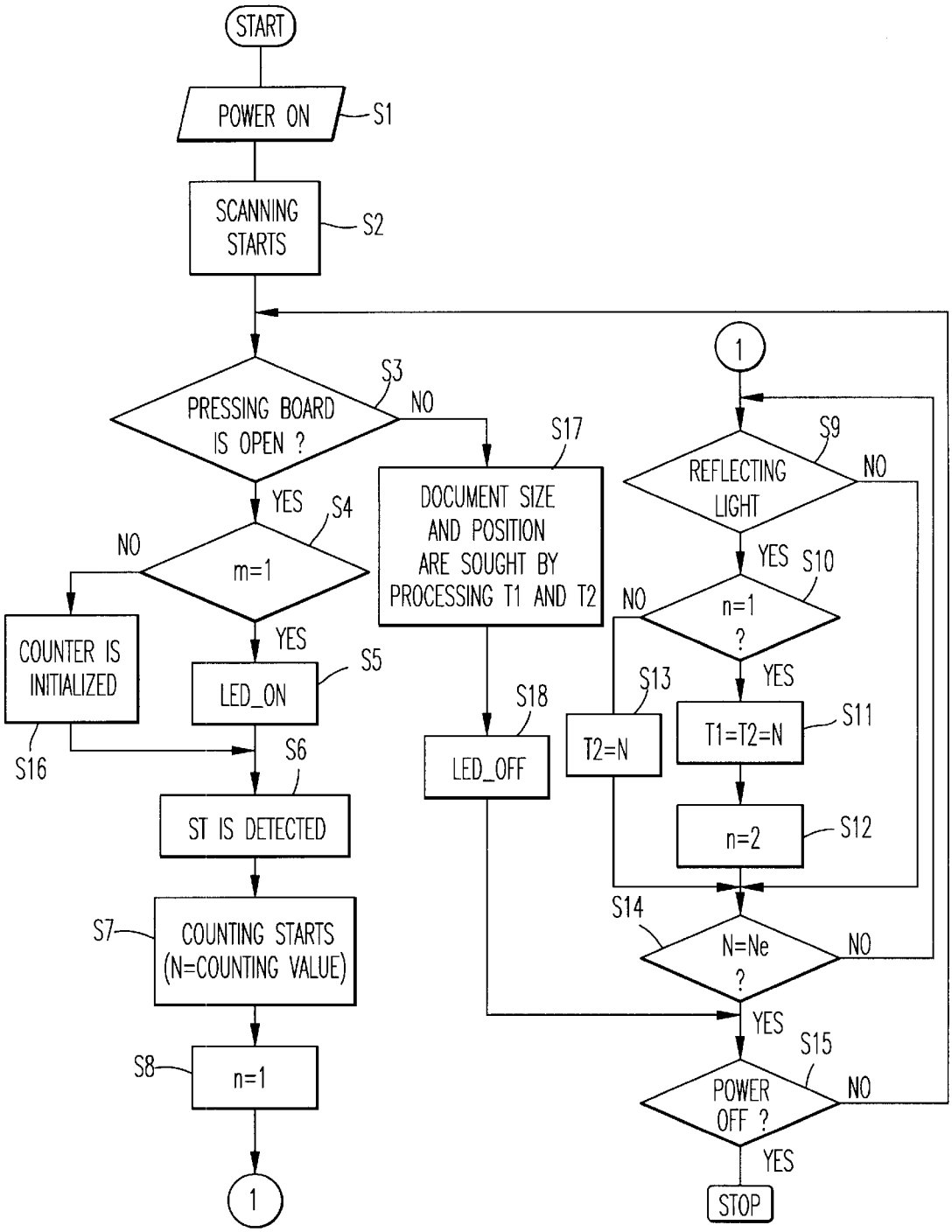
FIG. 10 in a flow chart illustrating operation of the first embodiment.

Next, overall operation of the first embodiment will be described, referring to the flowchart in FIG. 10.

The relay 49 becomes closed and the electric power supply VCC is supplied to the document detecting apparatus A (POWER ON, step S1), the scanning structure of the document detecting apparatus starts (scanning starts, step S2), and the control circuit 1 judges whether the pressing board 50 is open or closed (step S3).

If the control circuit judges that the pressing board is open and the scanning is a first time (m=1, step S4), the control circuit 1 outputs the control signal LED to the LED driving circuit 2 so that the light emitting diode 3 is modulated at the predetermined period (step S5). Then, the control circuit 1 detects an input of the reference position signal ST (step S6), a signal CNT is output to the counter 5, the counter 5 starts counting of the system clock SCLK (step S7), and a number of a counting value of the counter 5 is made one (step S8).

Light signals detected by the photodiode 8 are amplified and converted to binary by the light detecting circuit 7 and output as the detected light signal RCV as described above. The detected light signal RCV inputs to the reflected light detecting circuit 10, the level thereof is distinguished by being read in accordance with the clocks CK1–CKn of difference phases (step S9), and is output as the detecting signal PDT from the reflected light detecting circuit 10 to the control circuit 1.

The detecting signal PDT is judged by the control circuit 1 as to whether or not the detecting signal PDT represents a start of scanning light reflected from the document (step S9), and the counting value N of the counter 5 is input and written to the registers 4 (T1) and 11 (T2)(step S11).

In this case, when the detecting signal PDT is input from the reflected light detecting circuit 10, the control circuit 1 sets a logic value of a signal EN1 to "0" immediately, which is input to the register 4 making it hold the counting value N as register 4 counting value T1 at this time, and the control circuit similarly sets a logic value of a signal EN2 based on the detecting signal PDT to make register 11 hold the counting value N as register 11 counting value T2 (see FIG. 1).

Then, until the counting value of the counters becomes a predetermined value Ne by which a document of maximum size can be covered, the operation repeats. If the counting value of the counter 5 becomes Ne (step S14), the counter 5 stops the counting operation, the signal Ne outputs to the control circuit 1, the logic value of the signal EN2 is made "0" by the control circuit 1, and the counting value T2 when the detecting signal PDT outputs is held in the register 11.

As long as the electric power is ON and the pressing board 50 is open, if the scanning is not judged the first time (step S4), the counter 5 is initialized (step S16), step S6 is executed, and the same operation as described above repeats until the pressing board is closed.

If the pressing board is judged closed in step S3, a signal CAL is output from the control circuit 1 to the calculation processing circuit 14. The counting values T1 and T2, which are stored in the memory 13, are calculated by the calculation processing circuit 14 on the basis of processing data, which is read from the ROM 15 to determine the size and position of the document D (step S17), and the light emitting diode 3 is turned off by the LED driving circuit 2 (step S18), completing the document detecting operation.

As described the above, in this embodiment, when the pressing board 50 is closed as indicated by the logic value "1" of the signal COV, the logic value of the control signal LED becomes "0" and then the light emitting diode 3 is turned off. However, if the image forming apparatus is in a waiting state, the relay 49 is open and the electric power to the document detecting apparatus A is cut off.

Moreover, in the document detecting operation in this embodiment, when a front edge of the document D is detected, the detected light signal repeats binary values of "1" and "0", beginning with a "1" or "0". Further, when a back edge of the document D is detected, a position, which corresponds to one period before repetition of "1" and "0" of the detected light signal stops, identifies a position of the back edge of the document D.

Figure 8A:
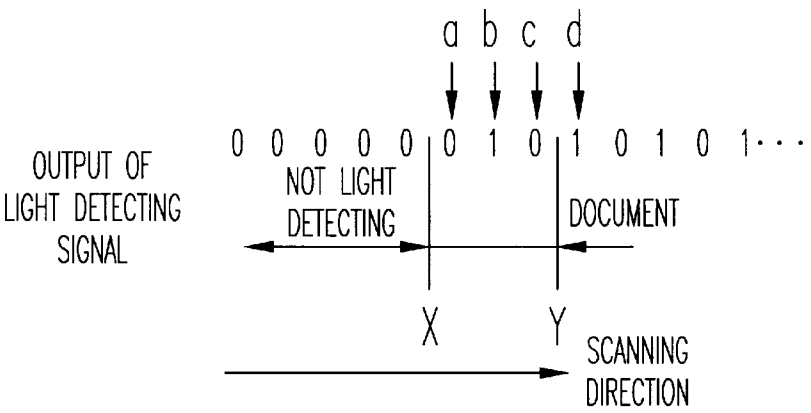
FIGS. 8(*a*) and 8(*b*) are explanation views illustrating judgment of a position of a front edge of a document according to the first embodiment.
Figure 8B:
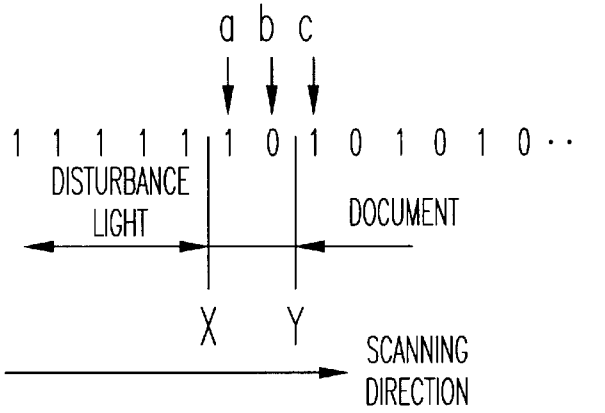

FIG. 8(*a*) shows logic values of the detected light signal from the front edge of the document arranged in the scanning direction when disturbance light is not definitely detected. The logic value of the detected light signal becomes "1" at a position b for the first time, however, this needs to be judged as either reflected light from the document or a disturbance light. If it is reflected light from the document, since a position a is during an OFF period of the light emitting diode 3, existence of the document cannot be determined.

On the other hand, if signal "1" at position b is disturbance light, the position d is a beginning of the reflected light from the document. Thus in this embodiment, it is determined that the edge of the document exists in a range between X and Y.

FIG. 8(*b*) shows the logic values of the detected light signal of the front edge of the document arranged in the scanning direction when disturbance light is definitely detected. A position a is judged to be either an end of the disturbance light or a beginning of the reflected light. If it is the beginning of the reflected light, the position a is an edge of the document, and if it is the end of the disturbance light, a position c is a beginning of the reflecting light and therefore corresponding to the edge of the document. Thus in this embodiment, it is determined that the edge of the document exists in a range between X and Y.

Figure 9A:
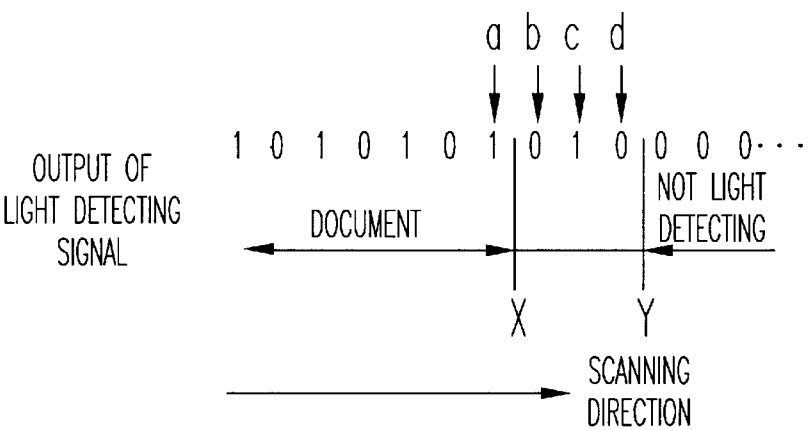
FIGS. 9(*a*) and 9(*b*) are explanation views illustrating judgment of a position of a back edge of a document according to the first embodiment.
Figure 9B:
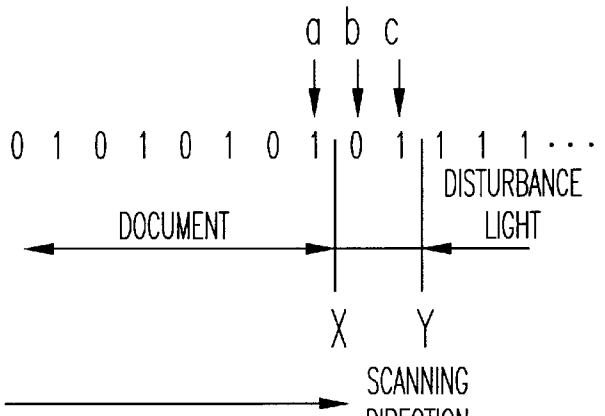

FIG. 9(*a*) shows the logic values of the detected light signal when a back edge of the document is arranged in the scanning direction and disturbance light is not definitely detected. A logic value "1" of the detected light signal ends at a position c, however, this is judged as either light reflected from the document or the disturbance light. If it is the reflecting light from the document, since a position d is in OFF period of the light emitting diode 3, existence of the document cannot be determined.

On the other hand, if a position c is the disturbance light, a position a is an end of reflected light from the document D. Thus in this embodiment, it is determined that the edge of the document exists in a range between X and Y.

FIG. 9(*b*) shows the logic value of the detected light signal when the back edge of the document is arranged in the scanning direction and disturbance light is definitely detected. A position c is judged a beginning of the disturbance light or an end of the reflected light. If it is the end of the reflected light, this is a back edge of the document D. If it is the beginning of the disturbance light, a position a is judged to be an end of the reference reflecting light. Thus in this embodiment, it is determined that the edge of the document exists in a range between X and Y.

As described the above, according to this embodiment, document detection continuously repeats as long as the pressing board 50 remains open. Thus, the document detection can be executed in high resolution and with high accuracy. A complicated design and mounting is unnecessary because structure of the apparatus can be made simple, and manufacturing cost can therefore be reduced. Further, electric power supply can be stopped when not needed, and thus operation life of parts can be extended and electric power can be saved. Even if properties of the optical system or the circuit system change, document detecting can be executed without influence of disturbance light, and without drop out of document edges.

Figure 11:
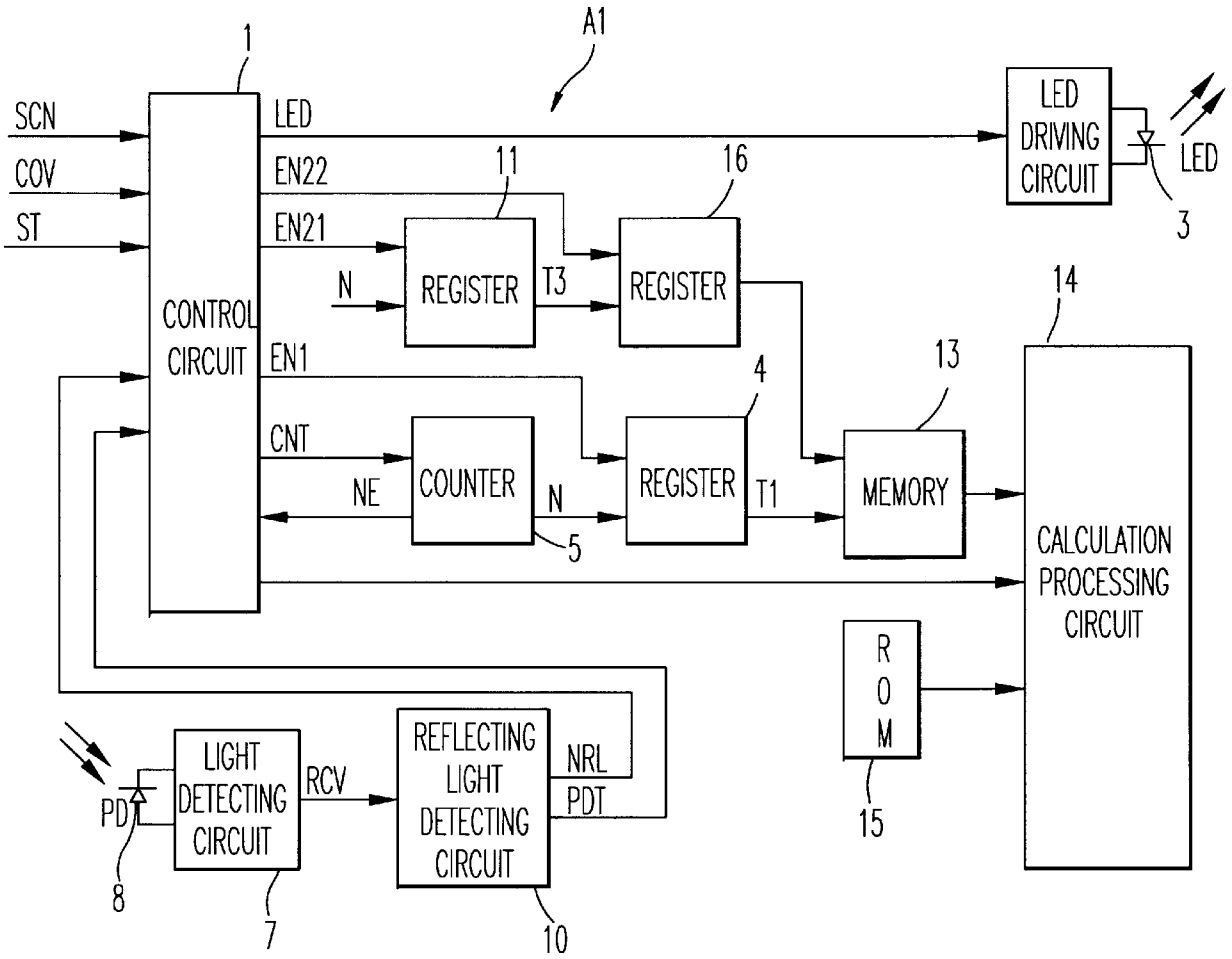
FIG. 11 is a block diagram illustrating a second embodiment of a document detecting apparatus according to the present invention.

A second embodiment will now be described, referring to FIG. 11, a block diagram showing a structure of this embodiment, and FIG. 12, a timing chart illustrating operation of this embodiment.

In the document detecting apparatus A1 of the second embodiment, a register 16 is present. An output terminal of the register 11 and an output terminal of the control circuit 1 are connected to input terminals of the register 16, an output terminal of the register 16 connects to the memory 13. When a logic value of a signal EN22 is set to "1" by the control circuit 1, data of the register 11 is input to the register 16.

Moreover, a signal SCN is output upon reading the document image set in the image forming apparatus where the document detecting apparatus A1 is installed. When repetition of logic value "1" and "0" of the detected light signal is not of a predetermined period and continues at greater than 1/fa, a signal NRL continuously outputs from the detecting circuit 10 to the control circuit 1. Once a logic value of the signal NRL becomes "1", until the detected light signal is of the predetermined period is not detected continuously at greater than 1/fa, a logic value of the NRL signal holds at "1". Further, in the control circuit 1, a device for measuring continuous output time of the detecting signal PDT, is installed.

The control circuit 1 in this embodiment functions to output the control signal LED when the signal SCN is input, and to turn off the light emitting diode 3 by appropriately signaling the LED driving circuit 2. The control circuit 1 also functions to restart by writing the counting value of the counter 5 to the register 4 by setting the signal EN1 which is set once to the logic value "1" and then back to the logic value "0", when a light of a period other than the predetermined period is detected just before or just after the alternating logic values "1" and "0" of the predetermined period on the basis of the detecting signal PDT is detected, and the logic value of signal NRL becomes "0".

The control circuit 1 also functions to hold the logic value "1" of the signal EN1, when the alternate of logic value "1" and "0" of the predetermined period on the basis of the detecting signal PDT is detected continuously more than a predetermined time Tp, and even if a light of a period other than the predetermined period is detected just before or just after the detection of the alternate of logic value "1" and "0" and the logic value of signal NRL becomes "0".

Other structures in this embodiment are the same as those of the first embodiment described above as referred to FIGS. 1–5, and thus a description thereof has been omitted.

Next, operation of this embodiment will be described. As described above in the first embodiment, the scanning light emitted from light emitting diode 3 and modulated at the predetermined period is incident to the document. As shown in FIG. 12(*a*), detected reflected light L, originating from light emitting diode 3 reflected off the document is detected by the reflected light detecting circuit 10. The light detecting circuit 10 distinguishes the detected reflected light L (of the predetermined period) from detected disturbance light N of low frequency to detect the document.

Figure 12A:
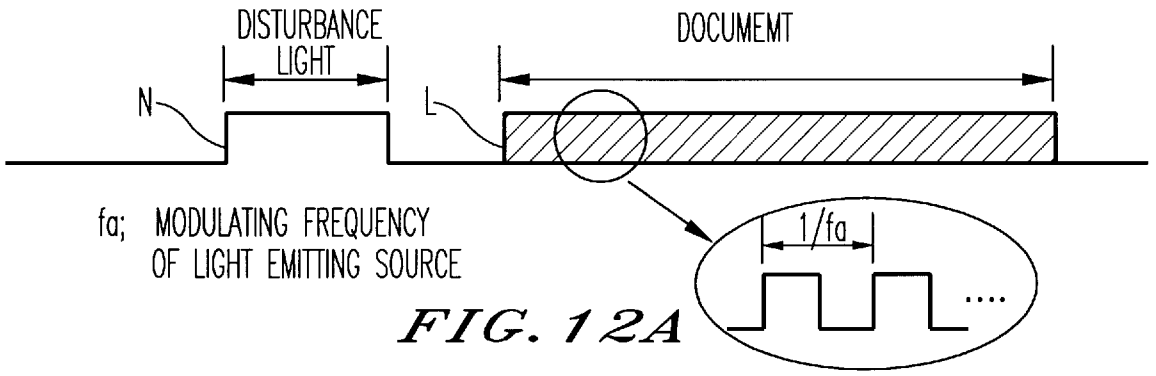
FIGS. 12(*a*), 12(*b*), and 12(*c*) are timing diagrams illustrating operation of the second embodiment upon occurrence of a disturbance light.
Figure 12B:
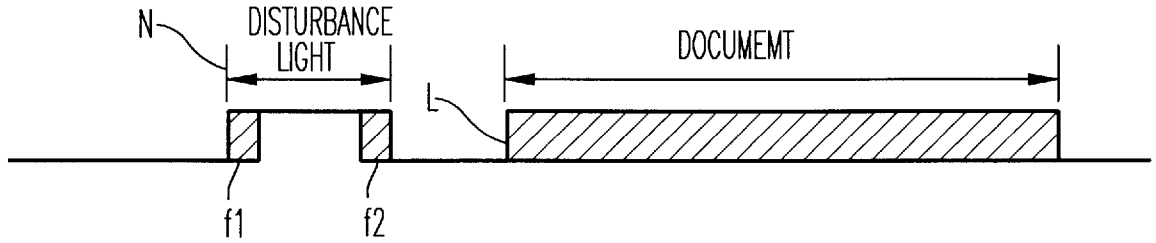
Figure 12C:
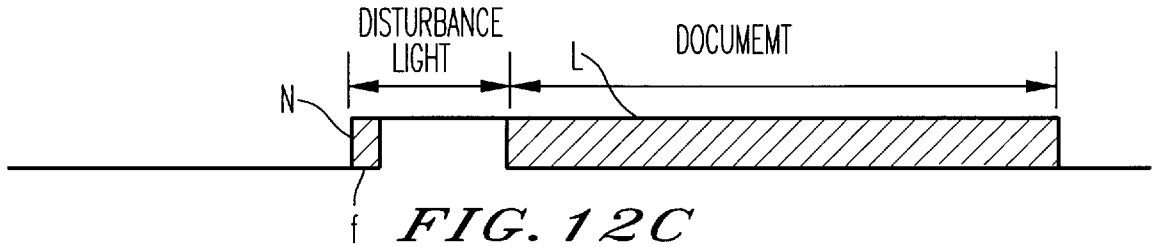

In this case, as shown in FIG. 12(*b*), in the detected disturbance light N, a leading edge portion f1 or a trailing edge portion f2 sometimes oscillates (caused by some levels or some waveform), preventing the first embodiment described above from distinguishing the detected reflected light signal L from the detected disturbance light signal N, and therefore preventing proper document detection.

In the second embodiment, even if the edge portion f1 of the detected disturbance light signal oscillates, and an oscillation period of the detected disturbance light signal N is equivalent to that of the detected reflected light signal L, and the detecting signal PDT is output, and the logic value of the signal EN1 is made "0" by the control circuit 1, and the counting value of the counter 5 holds in the register 4, if the detected disturbance light signal N, has a period different from that of the detected reflected light signal L, and is detected just after the oscillating signal of the edge portion f1 and the logic value of the signal becomes "0", the logic value of the signal EN1 is set to "0" again by the control circuit 1, and the holding of the register 4 continues, and writing of the counting value of the counter 5 to the register 4 restarts.

Similarly, when the edge portion f2 of the detected disturbance light signal N oscillates as shown in FIG. 12(*b*), and an oscillation period of the detected disturbance light signal N is the same as that of the detected reflected light signal L, even if the logic value of the signal EN1 is made "0" by the control circuit 1 and the counting value of the counter 5 holds in the register 4, if the detected disturbance light signal N, has a period different from that of the detected reflected light signal L, is detected just before the oscillating signal of the edge portion f2 and the logic value of the signal becomes "0", the logic value of the signal EN1 is set to "0" again by the control circuit 1, and the holding of the register 4 continues, and writing of the counting value of the counter 5 to the register 4 restarts.

Moreover, when the detecting signal PDT which repeats the alternate of logic value, "1" and "0" at the predetermined period continues more than the predetermined time Tp, and even if the detected disturbance light signal with a period different from the predetermined period is detected just before or just after the detection of the alternate of logic value "1" and "0", the logic value of the signal NRL is prevented from becoming "0" by the control circuit 1.

Thus, as shown in FIG. 12(*c*), when the detected disturbance light signal N connects to the edge portion of the detected reflected light signal and the logic value of the signal EN1 becomes "0", the logic value of the signal EN1 is not made "0" and the writing to the register 4 continues.

Further, while the detecting signal PDT of the predetermined period outputs and the logic value of the signal NRL is "1", the logic value of the signal EN21 holds "1" and the counting value of the counter 5 is written to the register 11. When the detecting signal PDT of the predetermined period continues to output more than a predetermined time Tp, or the logic value of the signal NRL does not become "0" just before or just after the detecting signal PDT of the predetermined period, after the output of the detecting signal PDT of the predetermined period ends, the logic value of the signal EN22 is made "0" during the predetermined time and the data of the register 11 inputs to the register 16.

On the other hand, during an operation for reading the document in the image forming apparatus, the signal SCN is input to the control circuit 1, the LED driving circuit 2 is driven by the control circuit 1, and the light emitting diode 3 is turned off.

Other operations in this embodiment are similar to that of the first embodiment described above and thus a description thereof is omitted.

As described the above, in addition to the technical advantage obtained in the first embodiment, even if an oscillating signal having a same period as the detected reflected light signal is generated at an edge portion of the detected disturbance light signal, high accuracy document detecting can be achieved.

A third embodiment will now be described, referring to FIGS. 13 to 17.

Figure 13:
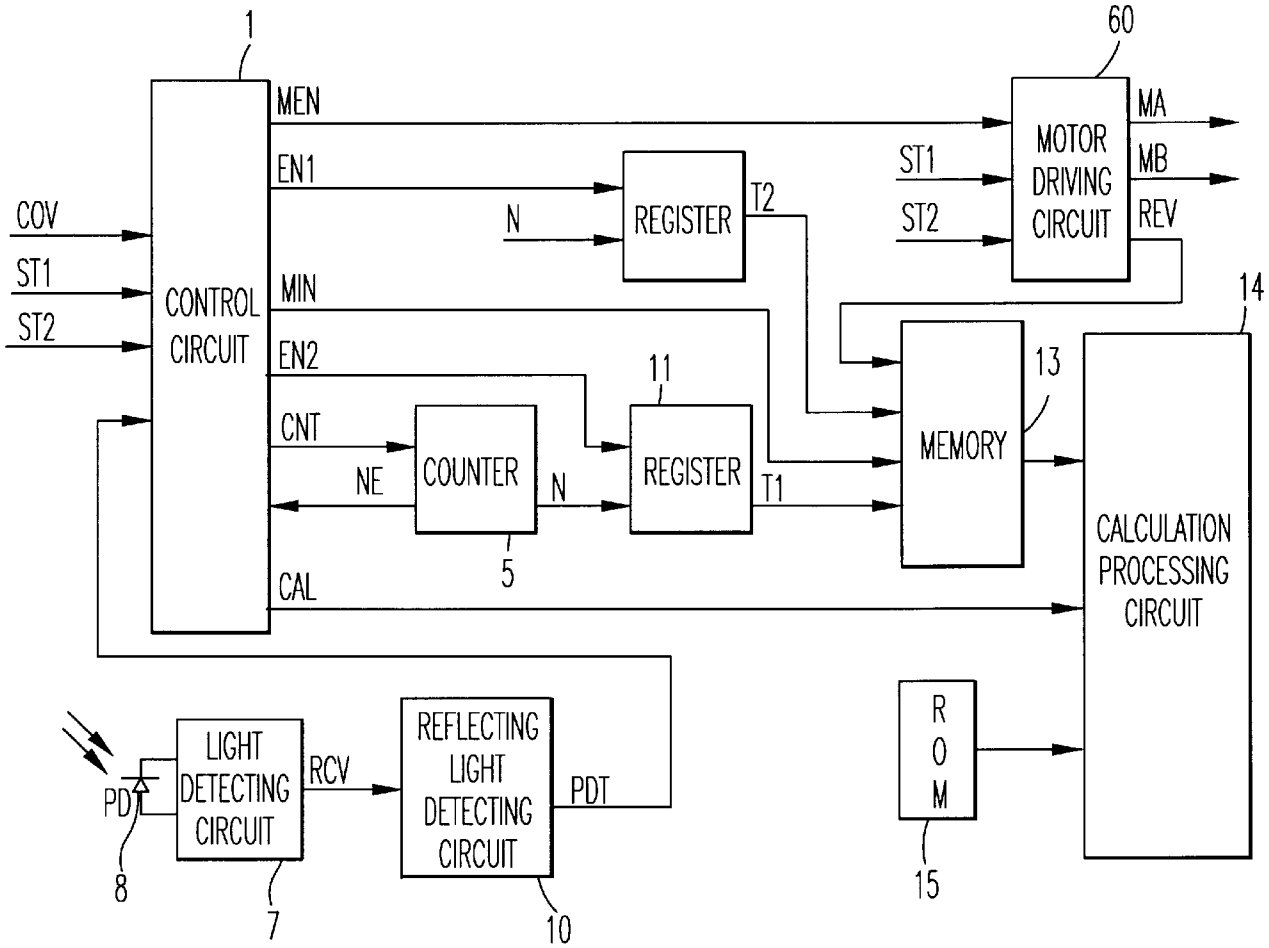
FIG. 13 is a block diagram illustrating a third embodiment of a document detecting apparatus according to the present invention.
Figure 14A:
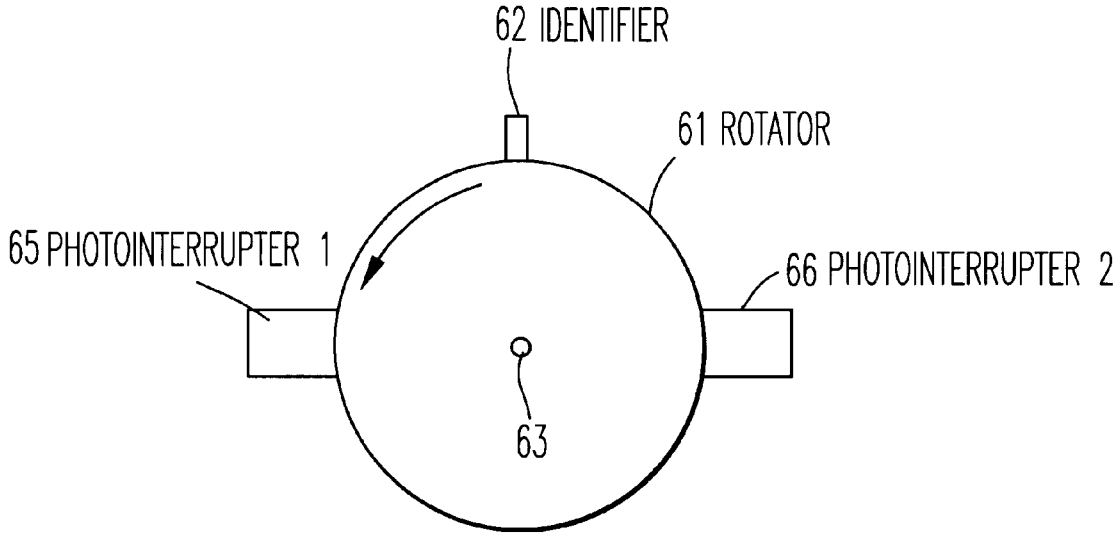
FIG. 14(*a*) is a top explanation view illustrating a structure of a motor according to the third embodiment.
Figure 14B:
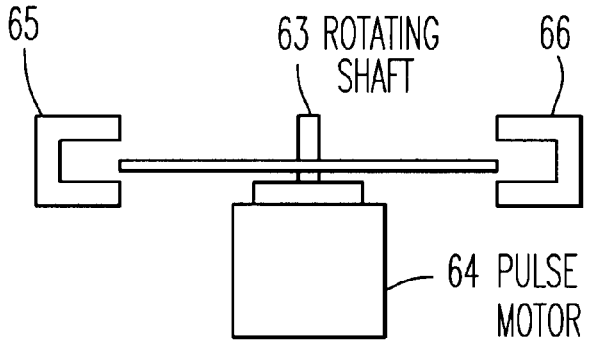
Figure 15:
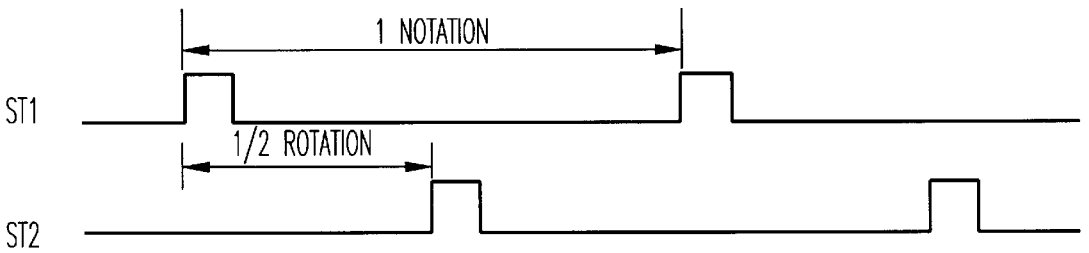
FIG. 15 is a timing diagram illustrating rotation detection of a motor of the second embodiment.
Figure 16:
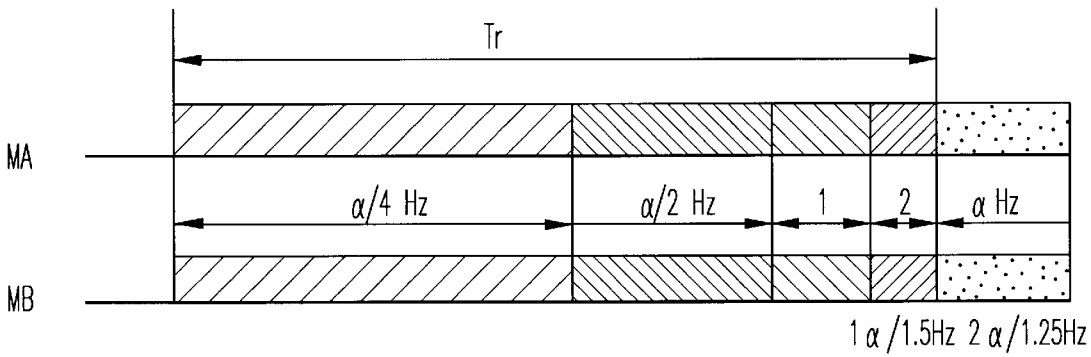
FIG. 16 is an explanation view illustrating frequency switching on restarting to drive a motor of the third embodiment.
Figure 17:
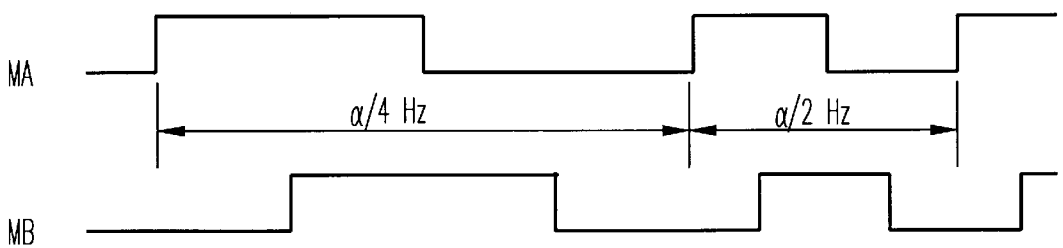
FIG. 17 is a diagram illustrating a driving signal of each phase on restarting to drive a motor of the third embodiment.

FIG. 13 is a block diagram showing a structure of this embodiment, FIG. 14 shows a structure of a motor of this embodiment, FIG. 15 is a timing chart showing rotation detecting operation of the motor of this embodiment, FIG. 16 shows frequency change of the motor on restarting to drive, and FIG. 17 shows a driving signal of each phase of the motor on restarting to drive.

In this embodiment, as shown in FIG. 13, a motor driving circuit 60 which drives a pulse motor for scanning an optical system connects to the control circuit 1 which is described above in the first embodiment referring to FIG. 1 and the output terminal of the motor driving circuit 60 connects to the memory 13.

As shown in FIG. 14, a rotor 61 of a disk form fixes to a rotating shaft 63 of the pulse motor 64 and an identifier 62 is extendedly formed at a periphery edge of the rotor 61. Photo interrupters 65 and 66 are installed in a straight line which passes a center of the rotating shaft 63 facing the periphery edge of the rotor 61. When the pulse motor rotates and the identifier 62 passes the photo interrupters 65 and 66, signals ST1 and ST2 output as shown in FIG. 15. A period when the scanning light scans the document is set so as to be from a leading edge of the signal ST1 to a leading edge of the signal ST2.

In this embodiment, position measuring of the scanning light is executed by a timer using an internal clock of a control system and the control circuit 1 functions to prohibit input of document detecting data when rotation of the pulse motor is not at a predetermined speed.

Other operations in this embodiment are the same as that of the first embodiment described above and thus a description thereof is omitted.

In FIG. 13, the LED driving circuit 2 and the light emitting diode 3 are omitted.

An operation of such a structure will be described.

When the control circuit 1 judges that the logic value of the signal COV is "0" and the pressing board is open, it outputs a signal MEN to the motor driving circuit 60 which rotates the pulse motor 64, and sets the registers 4 and 11 writable by outputting the signals EN1 and EN2.

Moreover, when the signal ST1 is input and the signal CNT is output from the control circuit 1, the counter 5 starts counting, and the counting value N of the counter 5 is written to the registers 4 and 11.

When the motor driving circuit 60 receives signal MEN, it begins driving pulse motor 64 via signals MA and MB of two phases different by ¼ phases that are output from the motor driving circuit 60. The driving signals MA and MB, as shown in FIG. 16, are output at a frequency of $\alpha$ Hz in a stationary rotating state, however, a low frequency of ¼ Hz outputs in order to obtain enough torque on rise time and frequency changes in steps. In this case, an shown in FIG. 17, the driving signals MA and MB are output so that one driving period of a next frequency continues after one driving period of a previous frequency.

On the other hand, the motor driving circuit 60 measures time from the leading edge of the signal ST1 to the leading edge of the signal ST2, and if the measured value is within a predetermined range, a logic value of a signal REV is made "1" and the rotation of the motor 64 continues. However, when the signal ST2 does not output within one period of the signal ST1 or the signal ST1 does not output within one period of the signal ST2, the logic value of the signal REV is made "0", and the output of the driving signals MA and MB stops, and control for driving the pulse motor restarts.

The output signal of the photodiode 8 is amplified and made binary by the predetermined threshold value in the light detecting circuit 7. The amplified binary signal is input to the reflected light detecting circuit 10 as the detected light signal RCV. In the reflected light detecting circuit 10, light modulated at the predetermined period is detected from the detected light signal RCV, and is output to the control circuit 1 as the detecting signal PDT.

The control circuit 1 sets the logic value of the signal EN1 to "0" by the input of the detecting signal PDT, and the counting value of the counter 5 at that time is held in the register 4 as a front edge data T1 of the document. Further, the signal EN2 transits in similar fashion when the detecting signal PDT ends, and the counting value of the counter 5 when the output of the detecting signal PDT ends is held in the register 11 as a back edge data of the document by the input of the signal ST2 or the signal Ne which outputs at a predetermined counting value of the counter 5.

Further, at this time, if it is judged by the signal COV that the pressing board is open, a signal MIN outputs from the control circuit 1 during a predetermined period, the counter 5 and the control circuit 1 are initialized, and the operation described above repeats.

On the other hand, at this time, if it is judged that the pressing board is closed, a signal CAV outputs from the control circuit 1, and detecting and calculating of the document are executed by the calculation processing circuit 14.

In the document detecting operation in this embodiment, only data detected during a normal rotating speed of the pulse motor 64 are input, and document detecting with high accuracy is therefore executed.

Other operations in this embodiment are the same as those of the first embodiment described above, and a description thereof has therefore omitted.

As described above, according to this embodiment, in addition to the technical advantage obtained in the first embodiment, if abnormal rotation of the pulse motor 64 which includes oscillation generates, restarting of the pulse motor 64 is immediately executed and a normal rotating state is set, and only data detected during normal rotation is input. Thus, a small size and low torque motor can be used, manufacturing cost is reduced, and document detecting with high accuracy is executed.

Finally, the technical advantages of the present invention will be described.

According to the present invention, while the opening of the document pressing device is detected by the opening or closing detecting device, the document detecting repeats emission of the scanning light incident to the document. Thus, a complicated design and mounting is not necessary and structure of the invention is simple, and the document detecting is performed with high accuracy as enough time is made available to detect the document.

According to the present invention, while the document pressing device is closed, emission of the scanning light to the document is stopped by a light emission stopping device. Thus, use of the light emitting source is reduced, and long life is achieved.

According to the present invention, in the waiting state of the image forming apparatus, the total operation of the document detecting apparatus is stopped by the operation stopping device (relay 49 and RDY signal, for example), and thus electric power is saved.

According to the present invention, the scanning light incident to the document is modulated at the predetermined period by the modulating device, and light reflected from the document is distinguished as to whether or not it is modulated at the predetermined period by a modulation distinguishing device (reflected light detecting circuit 10, for example), and the beginning of reflected light from the document at the predetermined period is detected as the front edge of the document and the end of the reflected light at the predetermined period is detected as the back edge of the document. Thus the size and position of the document is detected with high accuracy and without the influence of disturbance light.

According to the present invention, the scanning light is modulated at the predetermined period by a modulating device (LED driving circuit 2, for example), and the detected light signal RCV which is converted to binary with reference to a clock at constant period with respect to the predetermined period is detected and the signal is judged by detecting alternate logic values of "1" and "0" by the modulation distinguishing device. Thus, accurate document detection is possible without the influence of uncertain properties such as those present with analog processing.

According to the present invention, modulation distinguishing is executed independently by the plural clocks of which phases are different, and the judgment of light reflected from the document is executed by the modulation distinguishing device by at least one clock. Thus, even if the modulating period of the reflected light is changed by the optical system or the circuit system, detection of reflected light from the document is executed accurately.

According to the present invention, the detecting position of the beginning logic value "1" or the beginning logic value "0" if the predetermined number of the logic values "0" and "1" of the predetermined period are detected alternately and continuously is detected as the front edge position of the document. Thus, the front edge of the document is detected with high accuracy and without drop out as described above.

According to the present invention, the detecting position before the period of the clock from the detecting position in which the logic values "0" and "1" of the predetermined period are not detected alternately and continuously, is detected as the back edge position of the document. Thus the back edge of the document is detected in high accuracy and without drop out.

According to the present invention, if light of a period other than the predetermined period is detected just before or just after the alternate of the logic values "1" and "0" of the predetermined period is detected, the judgment by the modulation distinguishing device is canceled by a judgment canceling device (reflected light detecting circuit 10/control circuit 1, for example). Thus an oscillating portion generated at the front edge or the back edge of the detected light signal because of the disturbance light in accordance with the level or the waveform of the disturbance light is prevented from being recognized as a front or back edge of the document erroneously. According to the present invention, if the alternate of the logic values "1" and "0" of the predetermined period continues more than the reference time, the operation of the judgment canceling device is prohibited by the judgment prohibiting device. Thus even if the disturbance light overlaps the edge of the document, document detection is possible in high accuracy without the influence of the disturbance light.

According to the present invention, if an abnormality in the motor is detected, the motor restarts to be driven in the normal rotating state by a restarting drive device (motor driving circuit 60, for example). Thus, the document detection is possible with high accuracy using a small size and low torque motor, and a small size of the apparatus and reduction of manufacturing costs are possible.

According to the present invention, rotation is detected one by one at the plural positions in one rotation of the motor. Thus, a rotation abnormality of the motor in the oscillating state is effectively detected, and the reliability of the rotation detecting operation is improved.

According to the present invention, if the rotation of the motor arrives at the predetermined speed, the measuring value by the timer operated not synchronously with the rotation of the motor is judged effective by a rotation judging device (photo interrupters 65 and 66/Identifier 62, and control circuit 1, for example). Thus, document detection with high accuracy without the correction of rotating error of the motor or an encoder, and small size of the apparatus and the reduction of the manufacturing cost proceed further.

Obviously, numerous modifications and variations of the present invention are possible in light of the above teachings. It is therefore to be understood that, within the scope of the appended claims the invention may be practiced otherwise than as specifically described herein.

The present application is based on Japanese Priority documents 1996-209340 and 1997-024350, which are incorporated herein by reference.

What is claimed as new and desired to be secured by Letters Patent of the United States is:

1. A document detecting apparatus installed and used in an image forming apparatus wherein a scanning light is incident to a document placed on a document mount and a size and a position of the document are detected by detecting light reflected from the document, comprising:

a document pressing device which presses the document on the document mount; and an opening or closing detecting device which detects opening or closing state of the document pressing device;

wherein:

while the opening state of the document pressing device is detected, a document detecting operation is executed repeatedly and a detecting result is renewed with each repeated document detecting operation, and prior to detecting that the document pressing device is closed or prior to an operation for reading an image of the document starts, the size and the position of the document are calculated based on the detecting result in a calculation processing device.

2. The document detecting apparatus according to claim 1, further comprising a light emission stopping device which stops light emission of the scanning light to the document if the document pressing board is closed.

3. The document detecting apparatus according to claim 1, further comprising an operation stopping device which stops total operation of the document detecting apparatus if the image forming apparatus is in a waiting state.

4. A document detecting apparatus installed and used in an image forming apparatus wherein a scanning light is incident to a document placed on a document mount and a size and a position of the document are detected by detecting light from the document, comprising:

a reference signal generating device which generates a reference signal indicating a start of scanning;

a modulating device which modulates the scanning light to the document at a predetermined period;

a modulation distinguishing device which distinguishes whether or not a light signal which is detected in a light detecting device is modulated at the predetermined period;

a measuring device which measures a position of the scanning light after the start of scanning; and a position detecting device which detects a beginning of a reflecting position of the document from which the light signal at the predetermined period is distinguished and determined to be a first position indicating a front edge of the document, and detects an end of the reflecting position from the document of the light signal at the predetermined period as a second position indicating a back edge of the document.

5. The document detecting apparatus according to claim 4, wherein:

the modulating device modulates at the predetermined period by one of executing an on/off command of the scanning light at the predetermined period and changing a light emitting level of the scanning light at the predetermined period; and the modulation distinguishing device detects the light signal which is converted to binary logic values of "0" and "1" based on a predetermined threshold level and a clock of a constant period corresponding to the predetermined period of the scanning light, and if the logic values "0" and "1" are alternately detected at the predetermined period, the logic values "0" and "1" are judged to be the scanning light reflected from the document.

6. The document detecting apparatus according to claim 5, wherein:

the modulation distinguishing device executes modulation distinguishing independently by plural clocks having different phases; and the judgment of the reflecting light from the document is executed by the modulation distinguishing device by at least one clock.

7. The document detecting apparatus according to claim 5, wherein a detecting position of a beginning logic value "1" or a beginning logic value "0", if a predetermined number of the logic values "0" and "1" of the predetermined period are detected alternately and continuously, is detected as the first position.

8. The document detecting apparatus according to claim 5, wherein said second position begins before the period of the clock from a detecting position in which the logic values "0" and "1" of the predetermined period are not detected alternately and continuously.

9. The document detecting apparatus according to claim 5, further comprising a judgment canceling device which cancels the judgment of the scanning light reflected from the document by the modulation distinguishing device if a light of a period other than the predetermined period is detected just before or just after the alternate logic values "1" and "0" of the predetermined period are detected.

10. The document detecting apparatus according to claim 9, further comprising a judgment prohibiting device which prohibits an operation of the judgment canceling device if the alternate of the logic values "1" and "0" of the predetermined period continues for more than a predetermined reference time.

11. A document detecting apparatus installed and used in an image forming apparatus wherein a scanning light is incident to a document placed on a document mount and a size and a position of the document are detected by detecting light reflected from the document, comprising:

a rotation detecting device which detects a rotating state of a motor, the motor controlling scanning by the scanning light;

a restarting drive device which restarts the motor in a normal rotating state if an abnormal state of the motor is detected.

12. The document detecting apparatus according to claim 11, wherein the rotation detecting device detects the rotating state of the motor by detecting the rotation one by one at plural positions during each rotation of the motor.

13. The document detecting apparatus according to claim 11, further comprising:

a timer which measures a position of the scanning light on the document mount not synchronously with the rotation of the motor; and a rotation judging device which the position measured by the timer is judged effective if the rotation detecting device detects that the rotation of the motor is at a predetermined speed.

* * * * *